US006038721A

United States Patent [19]

Gordon

[11] Patent Number: 6,038,721

[45] Date of Patent: Mar. 21, 2000

[54] SPLIT RAIL BED GUARD SYSTEM

[76] Inventor: Illinois J. Gordon, 1020 Rocky Branch La., Elgin, S.C. 29045

[21] Appl. No.: 09/166,742

[22] Filed: Oct. 5, 1998

[51] Int. Cl.[7] ..... A47C 21/00

[52] U.S. Cl. ..... 5/663; 5/424; 5/425; 5/658

[58] Field of Search ..... 5/424, 425, 663, 5/658

[56] References Cited

U.S. PATENT DOCUMENTS

| | | | |
|---|---|---|---|
| 3,742,530 | 7/1973 | Clark | 5/425 |
| 5,191,663 | 3/1993 | Holder et al. | 5/663 |
| 5,481,772 | 1/1996 | Glynn et al. | 5/663 |

*Primary Examiner*—Terry Lee Melius
*Assistant Examiner*—Fredrick Conley
*Attorney, Agent, or Firm*—Thomas L. Moses

[57] ABSTRACT

A system of padded covers that are attached to adjustable split bed rails, and which are pivotally engageable so that the bed rails may be adjusted with a bed without having to remove or reposition the bed rail covers. The bed rail cover system includes a pair of upper covers, which are mirror images of each other, so that they fit on the upper bed rails adjacent the head of the bed on both sides, as well as another mirror image pair of lower covers fitted over lower bed rails adjacent the foot of the bed on both sides. Each upper cover includes two sides having an upper end and a lower end. The upper end refers to the portion of the cover toward the head of the bed, and the lower end refers to the portion of the cover toward the foot of the bed. The lower covers each include a pair of longitudinal sides that form a slot therebetween, at an upper end. The lower end of the upper cover slides into the slot formed between the longitudinal sides of the lower cover. This arrangement allows the bed and bed rail covers to be adjusted without having to remove or reposition the covers, while simultaneously preventing a gap from forming between the upper and lower bed rails. The covers are secured to the bed rails by hook and fastener tabs, such as Velcro®, which are sewn onto the covers and fit around the bed rails for securement thereto. Openings may be defined within the upper and lower covers to correspond with the adjustable bed or other electronic controls, to provide access to those controls for a bedridden patient or caregiver.

14 Claims, 6 Drawing Sheets

SPLIT RAIL BED GUARD SYSTEM

BACKGROUND OF THE INVENTION

1. Field of the Invention

The present invention relates generally to covers for bed rails. Specifically, the present invention is a system of padded covers that are attached to adjustable split bed rails, and which are pivotally engageable so that the bed rails may be adjusted with a bed without having to remove or reposition the bed rail covers. The bed rail cover system includes a pair of upper covers, which are mirror images of each other, so that they fit on the upper bed rails adjacent the head of the bed on both sides, as well as another mirror image pair of lower covers fitted over lower bed rails adjacent the foot of the bed on both sides. Each upper cover includes two sides having an upper end and a lower end. The upper end refers to the portion of the cover toward the head of the bed, and the lower end refers to the portion of the cover toward the foot of the bed. The lower covers each include a pair of longitudinal sides that form a slot therebetween, at the upper end. The lower end of the upper cover slides into the slot formed between the longitudinal sides of the lower cover. This arrangement allows the bed and bed rail covers to be adjusted without having to remove or reposition the covers, while simultaneously preventing a gap from forming between the upper and lower bed rails. The covers are secured to the bed rails by hook and loop fastener tabs, such as Velcro®, which are sewn onto the covers and fit around the bed rails for securement thereto. Openings may be defined within the upper and lower covers to correspond with the adjustable bed or other electronic controls, to provide access to those controls for a bedridden patient or caregiver.

It is common for hospitals to have hospital beds that are adjustable to many different configurations to suit different medical needs and conditions. These beds typically have side guard rails to keep patients from falling out onto the floor. Because of the adjustable nature of these beds, generally each side of the bed contains two separate side guard rails to allow the upper portion of the bed to be adjusted with respect to the lower portion of the bed. One problem associated with this arrangement is that occasionally patients become caught between the two side guard rails, resulting in injury. Many patients having severe medical conditions cannot prevent their arms, legs, heads or necks from becoming caught between the rails, and if the bed controllers are accidentally activated during this time, serious injuries can occur.

Therefore, it would be desirable to provide a bed rail cover system that would allow the bed to be adjusted to any desired configuration, while preventing a gap from forming between the upper and lower bed rails. Further, it would be desirable to provide a bed rail cover system that would allow the bed to be adjusted without having to remove or reposition the covers with respect to the bed rails, and which could be cleaned without removal from the bed rails, as well.

2. Discussion of the Prior Art

| | |
|---|---|
| Mahoney | 4,215,446 |
| Marra, Jr. | 5,097,550 |
| Marra, Jr. | 5,175,897 |
| Holder, et al. | 5,191,663 |
| Haddock | 5,557,817 |

The Mahoney reference discloses a padded cover for a hospital bed side rail having two panels of padded material of a shape similar to the appropriate bed rail and of a size sufficient to completely cover and enclose the bed rail. The padded cover slides over the bed rail and is fastened thereto by detachable fastening means located along the lower edge of the panels.

The '550 Marra patent shows a bed rail cover system including a bed rail having a framework with a plurality of rails and a cover positionable over the framework. The cover is of unitary multiwall construction and includes an attachment flap engageable with one of the rails to secure the cover in position on the framework.

The '897 Marra patent teaches a bed rail cover system similar to the '550 system, but further including an aperture within the cover to provide access to a control panel or other equipment in the framework. Optionally the cover can include a cover flap for the aperture, which may be made of the same material as the cover, or may be made from a transparent material for visual and operational access through the transparent, flexible cover flap.

The Holder reference discloses a sideguard pad for use in conjunction with a hospital bed having sideguards comprising a slipcover having one compartment adapted to fit over the sideguard, and a pad disposed in another compartment of the slipcover which positions the pad inboard of the sideguard. Apertures are provided in the sideguard pad for accessing hospital bed controls located on the sideguard. Velcro® closures are used to secure the sideguard pad to the sideguard.

The Haddock patent shows a protective cover for removable placement over the restraining side rails of a hospital bed. The cover is made of a foamed plastic core covered by a soft material with the cover being foldable over the top of the side rail and hook and eye means positioned at each end and at the sides of the cover to secure the cover on the side rail.

None of the prior art, however, discloses a padded bed rail cover system that allows a bed having a split rail bed guard to be adjusted to any desired configuration, while preventing a gap from forming between upper and lower bed rails, and which may be cleaned without having to remove or reposition the covers with respect to the bed rails. Furthermore, the bed rail covers may be adjusted with the bed, without having to remove or reposition the covers with respect to the bed rails.

SUMMARY OF THE INVENTION

Accordingly, it is an important object of the present invention to provide a bed rail cover system for adjustable hospital beds having split upper and lower bed rails, where the upper and lower covers are pivotally engageable with respect to each other, thus allowing freedom of adjustability for the hospital bed while preventing a gap from forming between the upper and lower rails.

Another important object of the present invention is to provide a bed rail cover system that allows an adjustable hospital bed to be adjusted into many different configurations without having to remove or reposition the covers with respect to the bed rails.

Yet another important object of the present invention is to provide a bed rail cover system for covering hospital bed side rails with a padded cover, where the cover may be cleaned without being removed from the rails.

Still another important object of the present invention is to provide a bed rail cover system where each cover is removably secured to a corresponding bed side rail using hook and fastener tabs, such as Velcro®, and where each cover contains apertures corresponding to control panels located on the bed side rails to provide access to those panels.

Another important object of the present invention is to provide a system of bed rail covers that is easy and inexpensive to manufacture, and which overcomes some of the problems associated with other types of bed rail covers. These and other objects of the present invention will become apparent with a reading of the following specification, the drawings, and the appended claims.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1A:
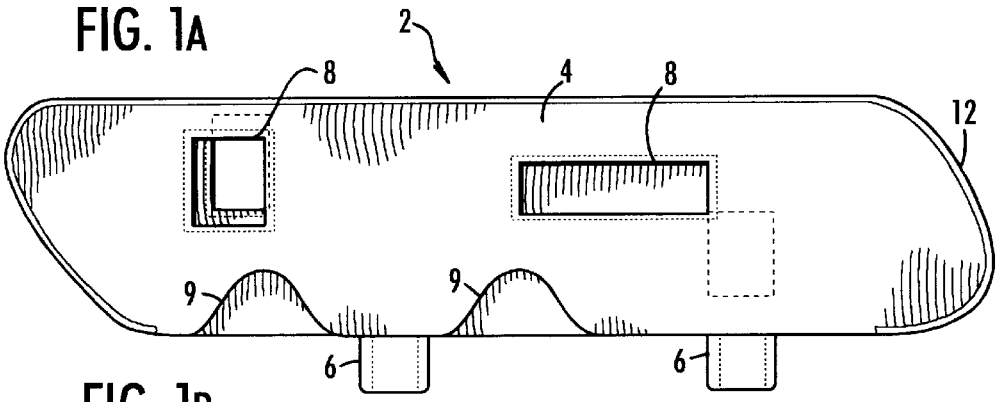
FIG. 1A is a side view of an inside portion of the upper cover.

The present invention includes a bed rail cover system having separate bed rail covers secured to each rail positioned on an adjustable, split rail bed. FIG. 1A shows the inner longitudinal side portion 4 of an upper bed rail cover 2 as viewed from the inside of the bed, which fits on a bed rail along the side of the bed adjacent the head of the bed. The upper bed rail cover is secured to the bed rails using tab fasteners 6, preferably hook and loop tab fasteners such as Velcro®. The cover, as shown in FIG. 1A defines a pair of holes 8 positioned to provide access to control panels located on the inside portion of the bed rail. The inner longitudinal side also includes a pair of indentations 9 along the bottom edge to accommodate the support posts that secure the bed rails to the bed itself.

Figure 1B:
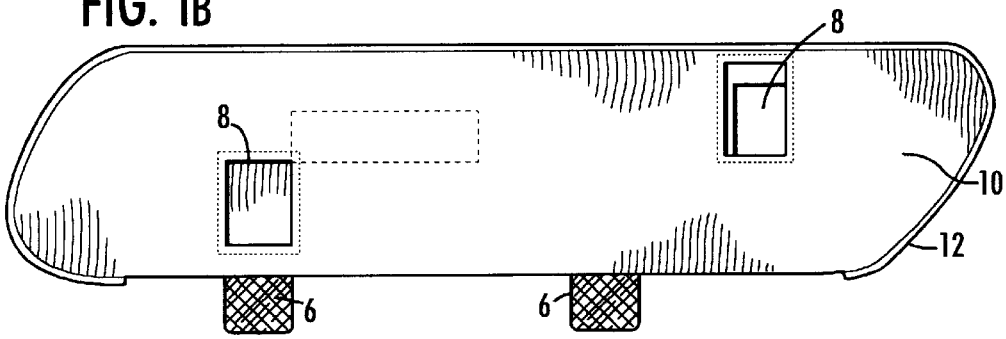
FIG. 1B is a side view of an outside portion of the upper cover.

FIG. 1B shows the same upper bed rail cover from the opposite side 10, which faces outwardly away from the bed when the upper bed rail cover is secured to the upper bed rail. This outwardly facing longitudinal side 10 of the upper bed rail also defines holes 8 positioned to provide access to control panels located on the outside portion of the upper bed rail.

The upper bed rail cover includes an intermediate portion 12 that connects the outer longitudinal side of the bed rail cover (FIG. 1B) to the inner longitudinal side of the bed rail cover (FIG. 1A) along the top and side edges, leaving the lower edges open and unconnected. To secure the upper bed rail cover to an upper bed rail, the open side of the upper bed rail cover slides over the bed rail, and then the fastener tabs along the open side of the cover are used to secure the cover to the bed rail. Another upper bed rail cover is formed similarly to the one described above, but is simply a mirror image of the one previously described, so that the upper bed rail covers may be formed to fit the upper bed rails on either side of the bed adjacent the head of the bed.

Figure 2A:
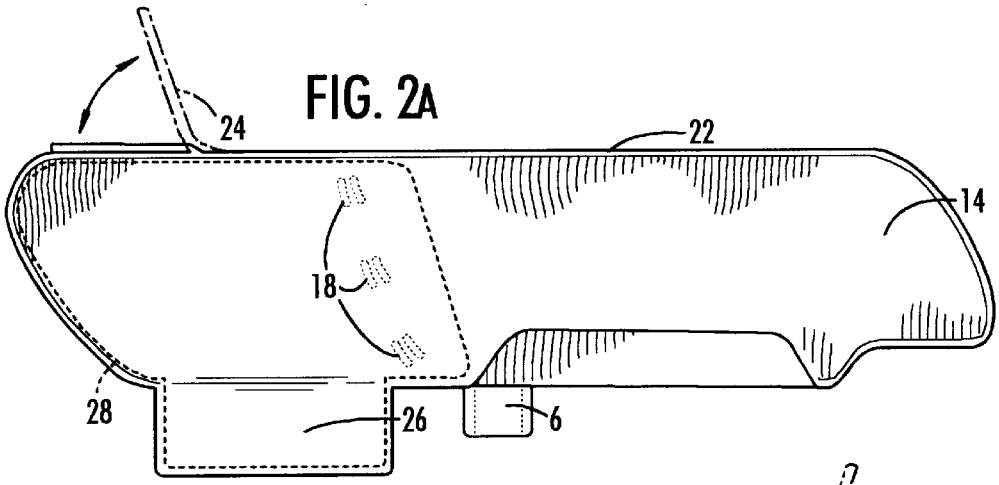
FIG. 2A is a side view of an inside portion of the lower cover.
Figure 2B:
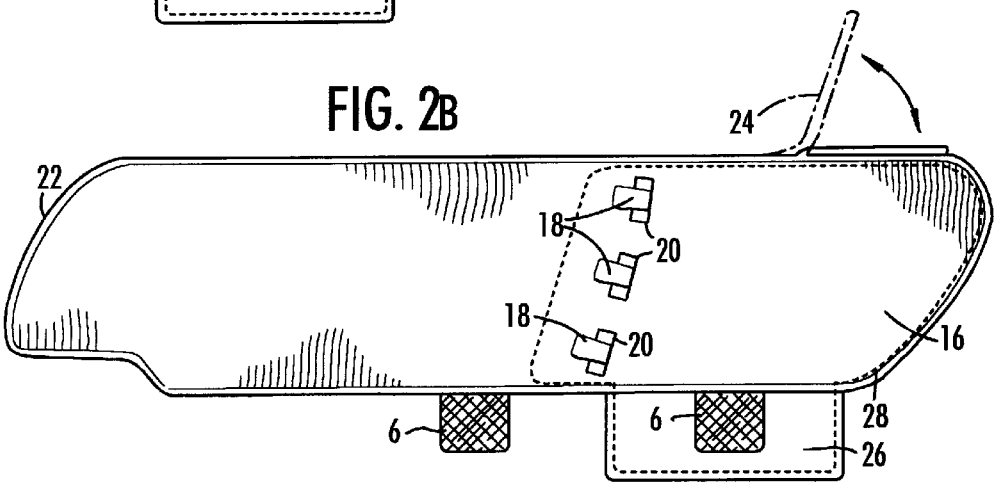
FIG. 2B is a side view of an outside portion of the lower cover.

FIG. 2A shows a lower bed rail cover, facing inwardly toward the bed, for covering a bed rail positioned along the side of the bed adjacent the foot of the bed. Hook and tab fasteners 6 are located along the bottom edge of the inside longitudinal member 14 (shown at FIG. 2A) and the outside longitudinal member 16 (shown at FIG. 2B) of the lower bed rail cover for securement of the cover to the lower bed rail. The underside of the inwardly facing portion of the lower cover includes several spaced hook and fastener tabs 18, for further securement to the bed rail. FIG. 2B shows the outside member 16 having a spaced set of holes 20 with a hook and fastener portion sewn adjacent the holes 20 for receiving the fastener tabs 18. An intermediate portion 22 connects the outside member with the inside member of the lower bed rail cover starting from a point adjacent the fastener closest to the foot of the bed, and continuing upwardly across the top edge of the lower cover. The intermediate portion forms an unconnected flap 24 at the top edge of the lower cover closest to the head of the bed. This arrangement allows the inside longitudinal member and the outside longitudinal member to form a slot therebetween, which allows the upper cover to slide therebetween when both covers are secured to the bed rails. An inner flap member 26 is disposed along a bottom edge of the inside portion of the lower bed rail cover, as shown in FIGS. 2A and 2B. The lower cover includes a rigid material 28 positioned within the inside and outside longitudinal members, extending from a point between the upper end of the lower bed rail and the upper end of the lower cover, to provide a rigid portion of the lower cover, which closes the gap between the upper and lower bed rails on either side of a split rail bed, and which provides rigid support for the cover portion that is positioned in the gap between the upper and lower bed rails.

In an alternate embodiment, the holes defined in the longitudinal sides of both the upper and lower covers, which provide access to control panels for adjusting the bed, may be covered with a clear plastic. This arrangement prevents foreign matter such as bacteria, liquids, or food material from coming into contact with the control panels. A patient may operate the control panel through the clear plastic portions by simply pressing the buttons on the control panel through the clear plastic portions.

Figure 3A:
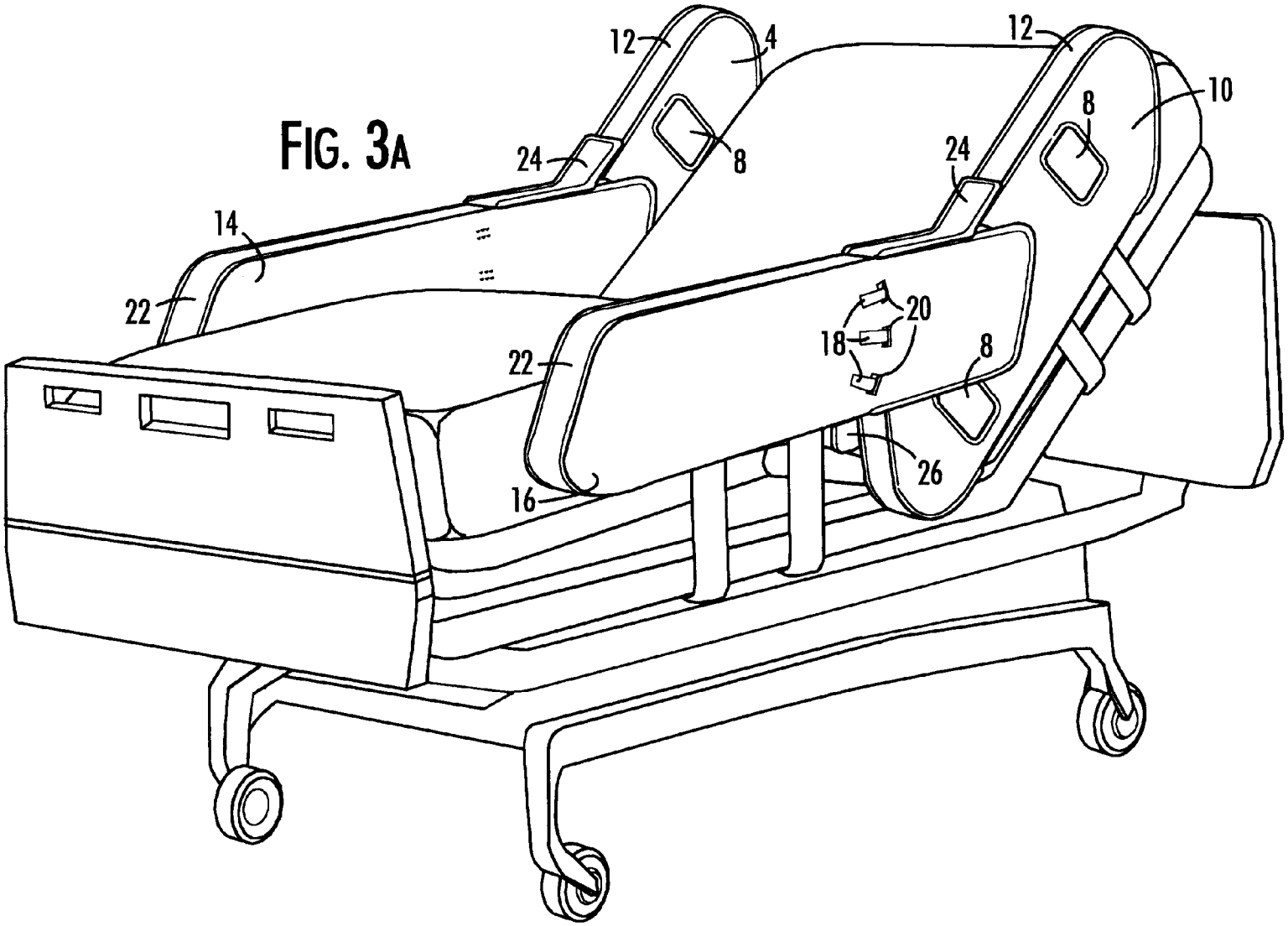
FIG. 3A is a perspective view showing the upper covers as mirror images of each other, attached to the upper bed rails, and showing the lower covers as mirror images of each other, attached to the lower bed rails, and also showing how the upper covers are pivotally engaged within the slots formed by the lower covers for adjustable relative movement.

FIG. 3A shows a split rail bed, where the upper portion of the bed (adjacent the head of the bed) is in a raised position.

As shown, the upper cover is disposed between the slot formed by the two longitudinal sides of the lower cover, thus preventing a gap from forming therebetween. The flap member 24 is shown conforming to the position of the upper cover member. In this embodiment, if the lower bed rail cover is positioned over a control panel located on the upper bed rail, the lower bed rail may be released from that position to provide access to the control panel.

Figure 3B:
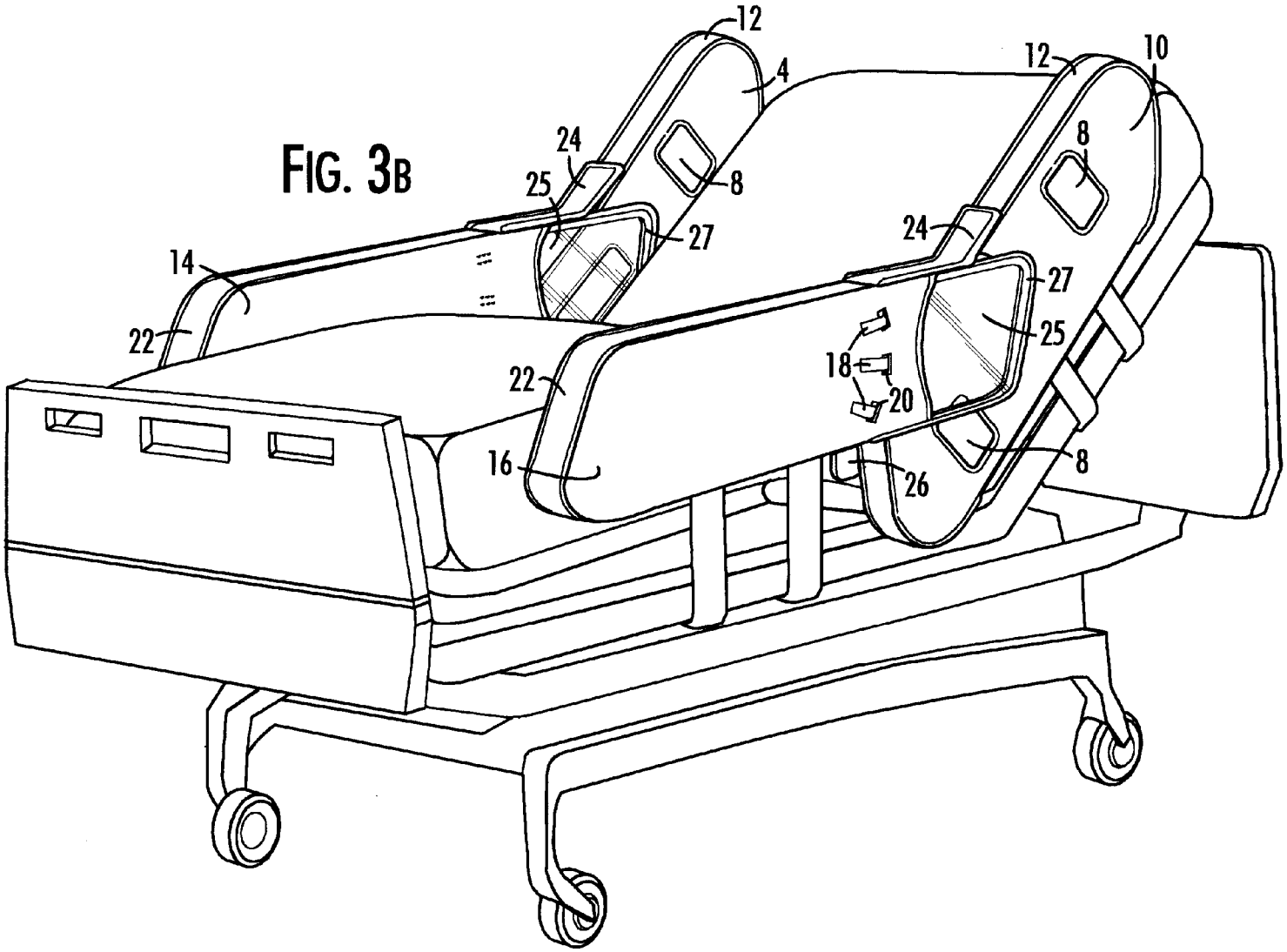
FIG. 3B is a perspective view of an alternate embodiment of that shown in FIG. 3A, including a clear plastic portion on each longitudinal side at the upper end of tie lower covers.

FIG. 3B shows an alternate embodiment of the upper bed rail covers, where the upper portion of each longitudinal side includes a clear plastic portion 25 formed about a rigid frame 27 defining an opening therein, so that the control panels showing through the outer and inner portion of the upper bed rail covers are still visible through the clear plastic portion. In this manner, a patient may have access for controlling the movement and adjustment of the bed even when the bed is in a configuration where the lower cover extends over these control panels.

Figure 4:
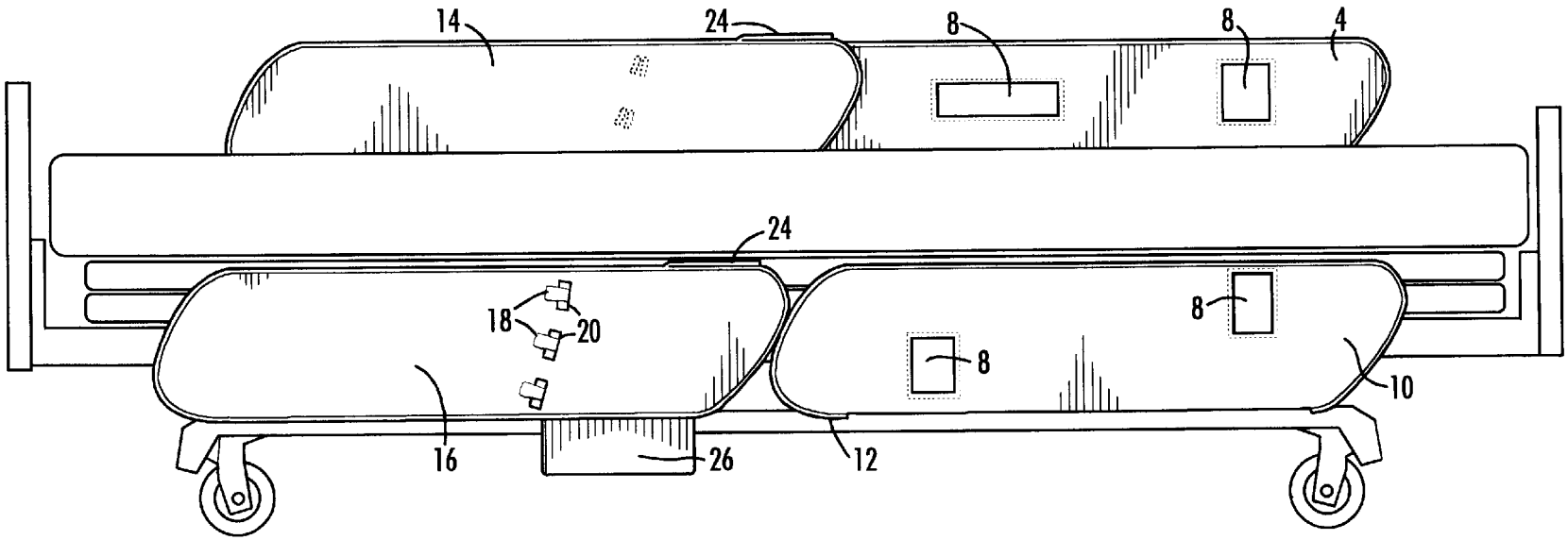
FIG. 4 is a side view showing the aft bed rails and covers in an upper, linear position, and showing the fore bed rails and covers in a lower, linear position.

FIG. 4 shows the bed in a linear horizontal position, where one side of the bed rails have been lowered into a position below the level of the mattress. This position may be used when transporting patients into and out of the bed. The other side of the bed is shown having the bed rails and covers in an upper position, as used when a patient is in the bed. In this position, it is clear that the bed rails in the upper position do not form a gap therebetween, due to the position and arrangement of the covers. The bed rail covers do not have to be removed from the bed rails in order to adjust the bed rails into the position shown.

Figure 5:
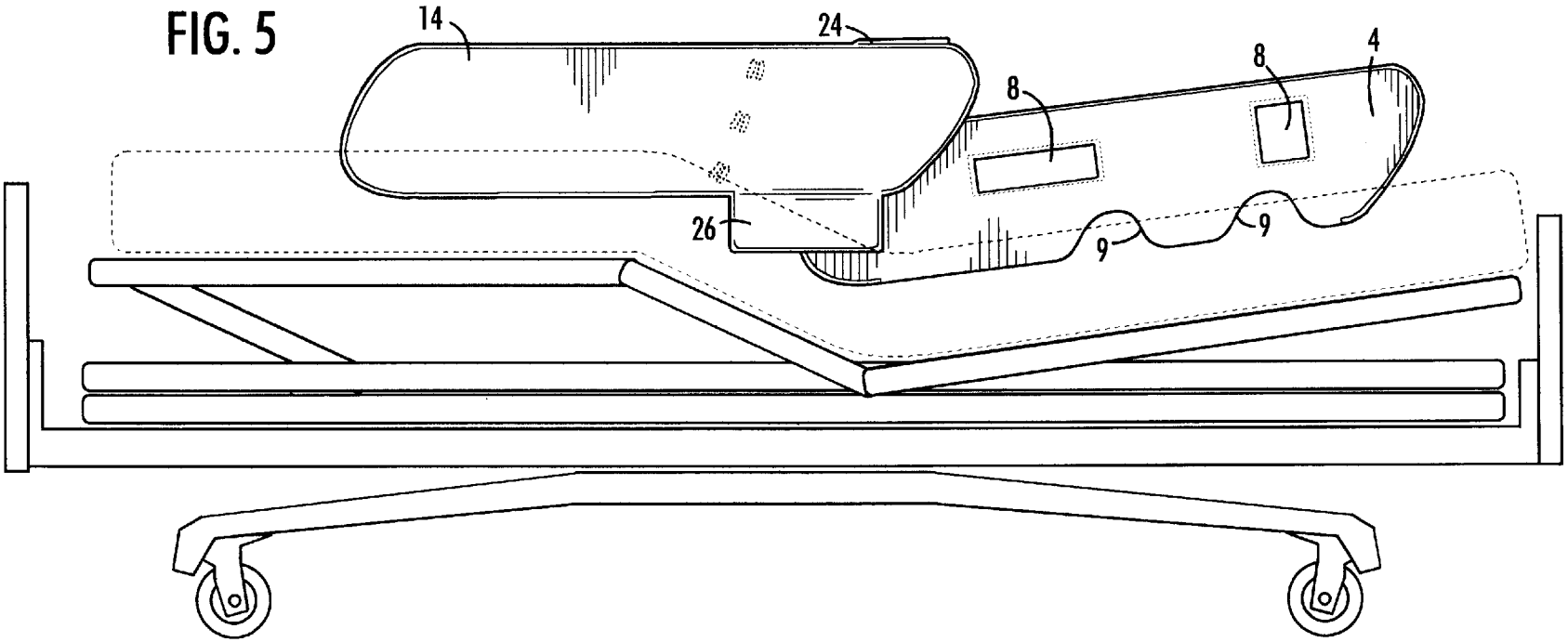
FIG. 5 is a side view of a hospital bed adjusted to an alternate configuration, showing the adjustably movable interactive relationship between the upper and lower bed rails and covers.

FIG. 5 is an illustration of the bed, where the upper portion of the bed adjacent the head of the bed is in a lowered position. Although the upper bed rails and covers are in a position lower than the lower bed rails and covers, the covers prevent a gap therebetween due to the position and arrangement of the bed rail covers.

Figure 6:
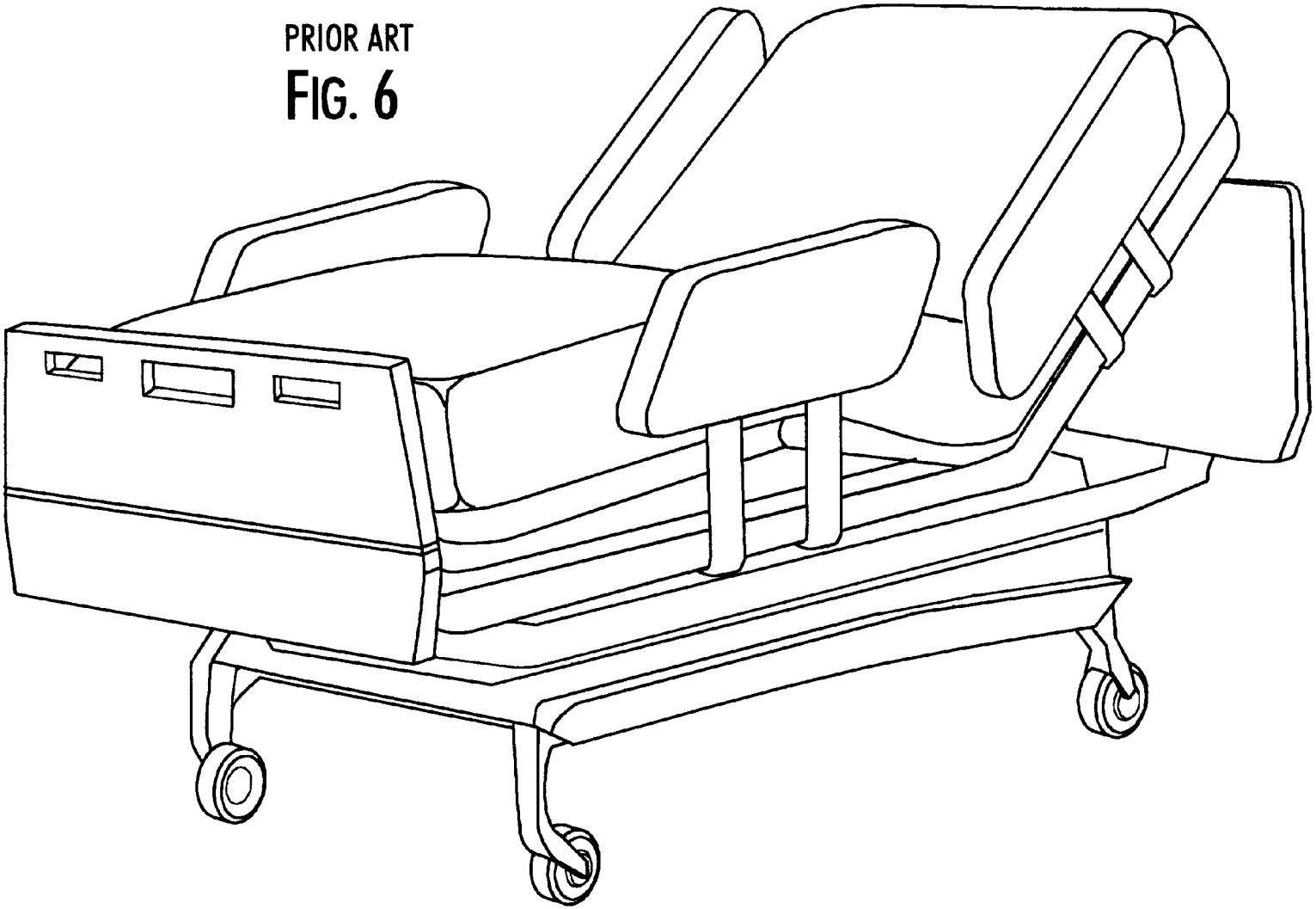
PRIOR ART FIG. 6
FIG. 6 is a perspective view of the prior art, showing the gap between the upper and lower bed rails.

FIG. 6 shows the prior art bed rail covers. This arrangement allows the bed rails to be covered with padded covers, but it does not prevent a gap from forming between the upper and lower bed rails. A patient who is placed in a bed having this type of bed rail cover system is in danger of becoming caught between the gaps formed by the upper and lower bed rails, thus subjecting that patient to possible injury.

In a preferred embodiment, each cover is made of an outer material, such as vinyl, Naugahyde, Bruin Tuff® or any other soft, flexible and easily cleanable material, and an inner padding material. Rigid material, such as strong plastic or wood, is disposed within the lower cover members at the upper end that forms the slot between the longitudinal sides, so that the sides will retain their shape within the gap between the bed rails.

It is to be understood that although the drawings show the bed rail covers in a specific shape, the shape of the covers will be determined by the shape of the bed rails. The bed rail covers may be custom fitted to various sizes and shapes of bed rails. The bed rail covers described herein prevent a gap from forming between the upper and lower bed rails, and may be cleaned without having to remove the covers from the bed rails, unlike the prior art. Further, the bed rail covers do not have to be removed in order to adjust the position of the bed or bed rails into any desired configuration. The padding portion of the bed rail covers helps to prevent a patient from bruising his or her body as a result of coming into contact with the bed rails or covers.

While a preferred embodiment of the invention has been described using specific terms, such description is for illustrative purposes only, and it is to be understood that changes and variations may be made without departing from the spirit or scope of the following claims.

What is claimed is:

1. A bed rail cover system for covering an adjustable split bed railing, said bed rail cover system comprising:

a first cover positionable over an adjustably movable upper bed rail, said first cover having a pair of longitudinal sides adapted to be disposed about opposite sides of said upper bed rail, and each side of said first cover having an upper end and a lower end;

a second cover adapted to be positionable over an adjustably movable lower bed rail, said second cover having a pair of longitudinal sides defining a slot therebetween at one end slidably engaging said lower end of said first cover;

said first cover being positioned so that said lower end of said first cover is slidably engaged within said slot defined by said longitudinal sides of said second cover, so that said upper and lower bed rails may be adjusted with said first and second covers secured thereto, thereby covering a gap between said upper and lower bed rails.

2. The structure set forth in claim 1, wherein said first and second covers are secured to said upper and lower bed rails by using hook and loop fastener tabs.

3. The structure set forth in claim 1, wherein said first and second covers contain a padding material therein.

4. The structure set forth in claim 1, wherein said longitudinal sides of said second cover also include a rigid, flexible material to support a portion of said second cover which is disposed over a gap between said upper and lower bed rails.

5. The structure set forth in claim 1, further including a plurality of openings in said first and second covers to allow access to control panels for adjusting said bed and said bed rails.

6. The structure set forth in claim 5, further including a clear plastic material for covering said openings allowing access to said control panel for adjusting said bed and said bed rails.

7. The structure set forth in claim 1, wherein said first and second covers are made from a vinyl coated fabric.

8. The structure set forth in claim 1, further including a pair of bed rail covers that are mirror images of said first cover and said second cover, so that said bed rail covers may be used on both sides of a bed.

9. The structure set forth in claim 5, further including a clear plastic portion positioned on said one end of each said longitudinal side of said second cover for providing visible access to said control panels when said second cover is in a position over said access control panels on said upper bed rails.

10. A method for covering a set of bed rails on an adjustable bed which will cover a gap between an upper bed rail and a lower bed rail, said method comprising the steps of:

providing a pair of custom fitted upper bed rail covers to be secured to a pair of upper bed rails;

providing a pair of custom fitted lower bed rail covers, which are slidably engaged with said upper bed rail covers to prevent a gap from forming between said upper and said lower bed rails.

11. The method set forth in claim 10, further including the step of providing openings within said bed rail covers to provide access to control panels for adjusting said bed and said bed rails.

12. The method set forth in claim 11, further including the step of providing a clear plastic member to cover said openings within said bed rail covers for providing access to control panels for adjusting said bed and said bed rails.

13. The method set forth in claim 10, wherein said covers also include a padding material therein.

14. The method set forth in claim 10, further including the step of securing said bed rail covers to said bed rails using hook and loop fasteners.

* * * * *